US006849004B2

(12) United States Patent
Lindsay

(10) Patent No.: US 6,849,004 B2
(45) Date of Patent: Feb. 1, 2005

(54) GOLF-PUTTERS

(76) Inventor: Norman Matheson Lindsay, 19 Batchelors Way, Amersham, Buckinghamshire HP7 9AH (GB)

( * ) Notice: Subject to any disclaimer, the term of this patent is extended or adjusted under 35 U.S.C. 154(b) by 0 days.

(21) Appl. No.: 10/276,643

(22) PCT Filed: May 16, 2001

(86) PCT No.: PCT/GB01/02163

§ 371 (c)(1),
(2), (4) Date: Nov. 15, 2002

(87) PCT Pub. No.: WO01/87427

PCT Pub. Date: Nov. 22, 2001

(65) Prior Publication Data

US 2004/0038747 A1 Feb. 26, 2004

(30) Foreign Application Priority Data

May 16, 2000 (GB) ..... 0011613
Jun. 23, 2000 (WO) ..... PCT/GB00/02437
Feb. 12, 2001 (GB) ..... 0103335

(51) Int. Cl.[7] ..... A63B 53/04
(52) U.S. Cl. ..... 473/330; 473/331; 473/340
(58) Field of Search ..... 473/330, 331, 473/290, 349, 324, 340, 341

(56) References Cited

U.S. PATENT DOCUMENTS 4,679,792 A * 7/1987 Straza et al. ..... 473/329
4,964,641 A * 10/1990 Miesch et al. ..... 473/330
5,154,425 A 10/1992 Niskanen et al. ..... 273/167 J
5,354,059 A * 10/1994 Stuff ..... 473/329
5,531,439 A * 7/1996 Azzarella ..... 473/331
5,542,675 A 8/1996 Micciche et al. ..... 473/329
5,618,239 A * 4/1997 Rife ..... 473/330
5,637,044 A * 6/1997 Swash ..... 473/331
5,709,616 A 1/1998 Rife ..... 473/330
5,766,093 A * 6/1998 Rohrer ..... 473/329
5,795,239 A * 8/1998 Lin ..... 473/255
5,863,262 A 1/1999 Donofrio ..... 473/330

FOREIGN PATENT DOCUMENTS

GB 2 313 552 A 12/1997 ..... A63B/53/04
JP 08229169 9/1996 ..... A63B/53/04
WO 99/04866 2/1999 ..... A63B/53/04
WO 00/20076 4/2000 ..... A63B/53/04

OTHER PUBLICATIONS

"How does RollGroove Technology work?", Guerin Rife Golf Inc., 2001, www.querife.com/technology.htm, 2 pp.

(List continued on next page.)

*Primary Examiner*—Sebastiano Passaniti
(74) *Attorney, Agent, or Firm*—Davis & Bujold, P.L.L.C.

(57) ABSTRACT

A golf-putter head (1) has a grooved impact face (5) defining lengthwise ridges (7) for impacting a dimpled golf-ball in areas of contact that are distributed around the dimples for improvement of putt accuracy by collectively centralizing the resultant striking force on the ball. The profile, width w and pitch p of the ridges (7) are selected according to hardness h and with p and w not exceeding 3.5 mm and (p−0.4) mm respectively, to reduce the standard deviation of dimple-effect error distribution by at least 15% in putting with initial ball-velocity of 2.5 m/s. Ridge-profile is symmetrically rounded (FIGS. 2,4,5,21), flat (FIG. 6,20) or segmented-flat (FIG. 3), or asymmetrical (FIG. 19), and test apparatus (FIGS. 11, 12) uses a linear actuator (33) for projecting the ball repeatedly to drop onto an impact-recording plate (36) to reveal scatter due to dimple-effect error.

44 Claims, 10 Drawing Sheets

OTHER PUBLICATIONS

"Midmallet and Tourblade", Guerin Rife Golf Inc., 2001 www.querinrife.com/putters.htm, 1 pg.

Tierney D. E. and Coop, R. H., A Bivariate Probability Model for Putting Proficiency, *Science and Golf III*, ed.: A. J. Cochran and M. R. Farrally, United Kingdom: Human Kinetics, 1999, pp. 385–394. (To follow).

Lindsay, Mr. N. M., "Golf and 'dimple error'", *The Times*, pub.: Times Newspapers Limited of London, Monday, Sep. 29, 1997.

Goldsmith, W., *Impact: The Hertz Law of Contact*, Chapter IV "Contact Phenomena Produced by the Impact of Elastic Bodies", pub. Edward Arnold, London: 1960, pp. 82–91.

Beauchamp, P.H. et al., "*Toward Putting Performance Enhancement: a Methodology Using Quantitative Feedback", Science and Golf II*, A. J. Cochran. ed., London: E. & F. N. Spon., pp. 174–179, 1994. (To follow).

Tierney, David E., PhD and Richard H. Coop, EdD, "A Bivarlate Probability Model for Putting Proficiency", *Science and Golf II*, A. J. Cochran and M. R. Farrally, eds., London: E. & F. N. Spon., pp. 385–394, 1998. (To follow).

* cited by examiner

| Test Number | 1 | 2 | 3 | 4 | 5 | 6 |
|---|---|---|---|---|---|---|
| Ridge Profile | (Flat) | | | | | |
| Pitch (mm) | N/A | 1.524 | 1.5 | 1.5 | 1.60 | 1.60 |
| Width (mm) | N/A | 0.61 | 0.62 | 0.36 | 0.33 | 0.25 |
| TSF | N/A | 0.63 | 0.56 | 0.57 | 0.51 | 0.54 |
| N | 1055 | 870 | 535 | 540 | 540 | 810 |
| s | **0.72°** | **0.66°** | **0.61°** | **0.53°** | **0.56°** | **0.55°** |

Fig. 17

| Test Number | 7 | 8 | 9 |
|---|---|---|---|
| Pitch (mm) | N/A | 3.3 | 1.6 |
| Width (mm) | N/A | 1.4 | 1.1 |
| N | 460 | 150 | 490 |
| s | 0.61° | 0.77° | 0.55° |

Fig. 18

GOLF-PUTTERS

FIELD OF THE INVENTION

This invention relates to golf-putters.

BACKGROUND OF THE INVENTION

It is known that even if a golf ball is putted with a 'perfect robot' (or any other form of precision mechanism) on a 'perfect putting surface', there will still be significant variation in the resulting ball-direction. The variation may be caused by spherical asymmetry in the mass and/or shape of the ball and by surface irregularities, in particular, in the dimpled-surface pattern. The dimpled pattern is an inherent part of golf-ball design and is provided to enhance aerodynamic performance.

In putting, the impact footprint (that is, the area of contact between ball and putter) has a span of the order of 5 millimeters, which is comparable with dimple-diameter. Since dimples cause voids in the contact between the impact face of the putter and the golf-ball surface, the impact footprint is rarely symmetrical. Moreover, the distribution of the striking force is not uniform across the footprint, but is a maximum at the initial point of contact, falling off rapidly towards the outer extremities of the footprint. Thus, the resultant striking force imparted by the putter on the ball is generally displaced from the ball-centre by a small, random amount. The degree and sense with which this gives rise to directional error in the resulting track of the ball from the line of strike, depends upon the extent to which the ball is struck more to one side than the other of the ideal centre-impact point; striking the ball more to the left of this point, propels it more to the right, and vice versa.

In addition to left/right (azimuthal) directional errors, the dimples similarly cause slight variations in the initial elevation trajectory. These errors can normally be ignored since they amount to slight variations in impact loft but do not measurably affect launch velocity or distance of putt. Accordingly, references to dimple-effect errors in the present context are to be understood to relate to errors in azimuth.

The errors due to the dimple effect are greater for hard-covered balls than for soft-covered balls, and less significant for long putts where the impact footprints are larger (because the striking force required is greater) so as to give a less asymmetric force distribution. Nonetheless, although dimple-effect errors are in any event small in relation to overall putting performance, they are significant because scoring in golf is heavily weighted by putt strokes.

One method of reducing dimple-effect errors is to provide golf balls with specially designed dimple patterns that distribute the impact force more evenly across the contact area. These modified dimple patterns may either cover the entire ball-surface or be limited to certain, identifiable zones; however, improving the dimple pattern for putting purposes, generally degrades the aerodynamic performance of the ball. A more practical approach instead, is to modify the impact face of the putter head itself to improve striking-force distribution so that the putter can be used advantageously with any make or pattern of golf ball.

SUMMARY OF THE INVENTION

It is an object of the present invention to provide a golf-putter head of improved form for reducing dimple-effect error.

According to one aspect of the present invention there is provided a golf-putter head having an impact face for striking the dimpled surface of a golf ball, the impact face being defined by a multiplicity of substantially parallel ridges which extend substantially lengthwise of the head and which are for impacting the ball-surface in areas of contact that are distributed around dimples of that surface to tend collectively to centralise the resultant striking force on the ball, wherein the ridges are of a profile, width, pitch and hardness which in combination result in said head realising a reduction of at least 15% in the standard deviation of the dimple-effect error distribution in putting with an initial velocity of 2.5 meters per second of a ball that when putted at that initial velocity by a head having a plain, flat impact face exhibits a standard deviation of dimple-effect error distribution within the range 0.69 degrees to 0.75 degrees.

Measurements show that dimple-effect errors in hard-covered golf balls have a standard deviation of about 0.7 degrees at one-STIMPMETER® putt strength when putted using a conventional metal putter having a plain, flat impact face. (The STIMPMETER® is a device for measuring the 'speed' or rolling friction of a putting surface; it also gives a measure of absolute putt strength.) Similarly, the standard deviation for dimple-effect errors with soft-covered (for example, balata) golf balls is found to be between 0.3 degrees to 0.4 degrees at one-STIMPMETER® putt strength. The standard deviations are found to increase by about 20% to 30% at half-STIMPMETER® strength, and it has been found that a golf ball with initial putt velocity of 2.5 meters per second and no initial spin travels very nearly the same distance as a ball launched from the STIMPMETER®. Since initial velocity can be determined very accurately, it is preferable to use this as a standard for putt strength.

Further measurements show that modifications to the impact face can markedly alter the degree of dimple error. It is possible to reduce dimple-effect errors significantly by altering the shape and/or the material of the impact face of the putter so as to improve impact-force distribution across the contact area. However, in some cases altering the shape of the impact surface increases rather than reduces the degree of error; this occurs when the impact face of the putter contains features that concentrate the striking force.

It has been estimated that a typical world-class golfer has on average a line error (i.e. directional error) of 1.3% and a length error of 6.5%. (Tierney, D. E. and Coop, R. H. 1999. A Bivariate Probability Model for Putting Proficiency, Science and Golf III, ed. A. J. Cochran and M. R. Farrally, 385–394, United Kingdom: Human Kinetics.) An average line error of 1.3% equates to a standard deviation from the ideal putt direction of 0.93 degrees. Other research indicates that players with a medium handicap have comparable chances of sinking putts at typically only half the range of world-class players (Beauchamp, P. H. et al. 1994. Towards putting performance enhancement: a methodology using quantitative feedback, Science and Golf II, ed. A. J. Cochran and M. R. Farrally, 174–179, London: E. & F. N. Spon.) From this, and assuming that skill level in both line and length are reduced in equal proportions, medium handicap players have typically 41% greater line error and 41% greater length error compared with world-class players. Thus, as a rough estimate, medium handicap players typically have a standard deviation of about 1.3 degrees in directional accuracy for putting. Most golfers will deviate above or below these values, but they give a basis for estimating the dimple-effect contribution to overall directional errors.

The separate contributions to overall directional error combine as the root mean square of magnitude. In the hypothetical case of the 'average' medium-handicap player, the standard deviation in degrees for non-dimple effect errors is given by:

$$(1.3^2 - 0.7^2)^{\frac{1}{2}} = 1.1$$

so dimple-effect increases average directional errors by 18%. By substituting the putter head with a type that reduces the dimple-effect standard deviation by 40% to 0.42 degrees, the degradation (i.e. increase in errors) in the above case is reduced to 7%. Conversely, a putter that increases the dimple-effect standard deviation by just 10% to 0.77 degrees increases the degradation to 22%.

Other forms of ridge-faced (or groove-faced) putters are known where the ridges are provided to increase the friction between ball and putter. The ridges in such putters are normally biased horizontally so that friction is especially increased in the vertical direction; it is asserted by the proponents of such ridges that they impart topspin to the ball at impact and that this improves putting accuracy. In some instances, dimple-effect errors are reduced by such ridges, but the improvement is small.

According to another aspect of the present invention, there is provided a golf-putter head having an impact face for striking the dimpled surface of a golf ball, the impact face being defined by a multiplicity of substantially parallel ridges which extend substantially lengthwise of the head with a pitch p, and which each have a width w that is measured at 67% of ridge-depth from the apex where the ridge-depth is 0.3 millimeters or less, but otherwise measured at a depth of 0.2 millimeters from the apex, a hardness h and a profile represented by a parameter TSF, related to p, h, and w as follows:

$$1.0<p<400/(h+100)$$

$$w<0.4\times p[80/(h-20)]$$

$$0.5<TSF<(0.91-0.003\times h)$$

for p not exceeding 3.5, w not exceeding (p−0.4) and TSF not exceeding 0.72, where h is measured in durometer Shore D scale, w and p in millimeters and TSF is the ratio of the cross-sectional area of the ridge-profile measured to a depth of 0.1 millimeters from the apex to its cross-sectional area measured to a depth of 0.15 millimeters from the apex.

The ridges of the putter-head according to both aspects of the invention specified above may be curved or slanted, but are preferably straight and parallel to the heel-toe axis of the head. Discontinuities along the length of the ridges may be used for cosmetic effect, but such discontinuities should not encroach within the normal ball-contact zone of the impact face, as these would tend to increase lateral friction in a random manner.

The ridges form impact surfaces having raised elements, which provide a plurality of separate contact areas with the golf ball such that increased depth of deformation of contacting surfaces occurs during impact with the ball and the width of each contact area is substantially smaller than the overall footprint span. For a given golf-ball cover-material and a given putter impact face material, the maximum deformation depth according to the present invention is more than the maximum depth obtained with a conventional plain, flat-faced putter and an equal putt strength. Thus, using a putter according to the present invention increases the overall footprint area.

The reduction of dimple-effect errors depends on the distribution of impact force being more evenly distributed laterally about the ideal centre of impact (that is to say, the centre of impact that would be obtained with a perfectly smooth and spherical ball). This more even distribution is provided by the present invention, in which the concentration of force that occurs near the centre of impact with a conventional flat-faced putter is replaced by a plurality of separate forces arranged to act on narrow elongate horizontal areas that act on different parts of the golf-ball dimple patter. The random error components from each of the separate forces will tend to cancel one another, provided that these separate forces are of roughly similar magnitude. However, if one contact force from, for example, a ridge-faced putter is dominant, then such random cancellation is not effective.

It is found with ridge-faced putters that dimple-effect errors are sensitive to the position of the ridges relative to the centre of impact. With horizontal ridges, worst case errors occur when one ridge is coincident with the centre of impact and the two adjacent ridges are displaced by one pitch distance, one above and the other below the centre of impact. This impact condition maximises the 'dominant ridge effect', which tends to increase dimple-effect errors. Conversely, if the centre of the gap between two ridges is coincident with the centre of impact, dimple-effect reduction is greatest. The difference between the worst and best case ridge alignments can be large. When measuring the effectiveness of a given ridge configuration, it is preferable to arrange for the test set-up to give worst case positioning of the ridges. This results in an underestimate of the overall dimple-effect improvement but gives a much more sensitive and reliable indication of the relative performance of different ridge-configurations.

A further advantage of horizontal ridges is that greater vertical traction between the putter and the golf ball is provided. Such modification enhances the ability of a putter to transmit topspin to a ball at impact. The ability of a putter to impart topspin at impact is generally considered advantageous and it is said that increased topspin at impact improves putting accuracy.

The deeper deformation in separate contact areas gives rise to higher localised stress levels and tends to increase the degree of plastic deformation during impact. Preferably, plastic deformation in a golf ball should be minimised so that most of the deformation is elastic. Thus, it is found that one form of ridged impact surface can make deeper deformation compared to a second form at the same putt strength yet exhibit less dimple-effect improvement.

Dimple-effect performance cannot be predicted by theoretical means or known design rules, so improved impact surfaces are developed using experiment and measurement. The applicants have devised a preferred measurement technique involving ballistic measurement. This replicates the required putt conditions (for example, a ball launch velocity of 2.5 meters per second with zero imparted spin) but at a known height and position above ground level. The direction of the ball trajectory through the air is then accurately measured using mechanical or electronic means. This technique ensures that errors from putting surface defects and mass imbalance effects in the ball are excluded.

The dimple-effect performance of a putter is preferably evaluated at one standard putt condition and with one golf ball category. Thus a standard putt condition with an initial launch velocity of 2.5 meters per second and zero imparted spin is adopted. Small deviations from this standard putt condition can be ignored, since dimple-effect errors vary slowly with change in impact energy. The preferred ball category includes any hard-covered golf ball that exhibits a standard deviation for dimple-effect errors of about 0.72 degrees at 2.5 meters per second putt strengths. This standard deviation of dimple errors is common to a wide range of golf balls of different brands.

The standard putt condition and golf ball category provides a reliable indicator of overall dimple-effect performance. Tests carried out by the applicants show that ridge-faced putter-heads with improved dimple-effect performance using hard-covered golf balls also exhibit improved performance using soft-covered golf balls, although the degree of improvement is not generally as great as with hard-covered golf balls. Tests also show that such heads exhibit very little degradation in elevation angle errors (that is in vertical launch-angle variations resulting from the dimples).

The putter face and the ridges may be fabricated from a hard rigid material, a soft resilient material or any material intermediate these. The ridges can be of the same material as the remainder or bulk of the putter-head, or formed of a different material. Thus, the ridges can be provided as individual raised inserts embedded into the base material of the putter face. Alternatively, the individual raised inserts can comprise several elements or pixels in a ridge-like structure, with uniform or varying element properties along the length of the ridge.

It is found that dimple errors are significant for impact deformation depths of about 0.15 millimeters, whereas the errors with impact depths of 0.4 millimeters to 0.5 millimeters or greater are negligible. Thus, the invention is particularly concerned with the shape and dimensions of ridge extremities ranging from the outer contacting surface—the apex—of the ridge, down to a depth of 0.5 millimeters from the apex. The shape of the tip of the ridge, in the sense of the shape of that part of the outer extremity of the ridge extending down to a depth of 0.15 millimeters from the apex, is relevant. The width of the ridge is also relevant in terms of its cross-sectional thickness as measured at 67% of ridge-depth from the apex in those circumstances where the ridge-depth is 0.3 millimeters or less, but otherwise measured at a depth of 0.2 millimeters from the apex.

In practice, the preferred width and pitch of the ridges are a function of the hardness or softness of the ridge material. Thus, the preferred width and pitch vary continuously throughout the range of material hardness, as do the preferred tip shapes.

With hard ridges it is preferable to have significantly smaller widths when the ridges are closely spaced (for example, when the pitch is 1.2 millimeters or less). The much smaller widths slightly reduce the force contributions from individual ridges, which compensates for the close spacing. Typically, the width w for hard ridges is within a range specified by:

$$w<0.4\times(p-0.4)$$

where width w and pitch p are in millimeters.

Thus, with a ridge spacing of 1.2 millimeters the preferred ridge widths are 0.32 millimeters or less, whereas with a pitch of 1.6 millimeters the preferred ridge widths can increase to 0.48 millimeters. In general, the widths for hard ridges as a function of pitch can extend within the range:

$$w<0.4\times p$$

where width w and pitch p are in millimeters.

A preferred range for ridge pitch in soft materials is 1.5 millimeters to 2.5 millimeters, but otherwise the range may extend from 1 millimeters to 3.5 millimeters. With softer material significant deformation depth can be achieved with relatively wide ridges and there is greater scope to enlarge impact footprint areas. It is also preferable to increase the width in proportion to the softness and flexibility of the ridge material to avoid a delicate structure that would tend to collapse on impact. Preferably, the maximum ridge-width w in millimeters in any material is:

$$w<0.4\times p\times[801(h-20)]$$

where p is ridge-pitch in millimeters and h is hardness measured in durometer Shore D scale.

As with hard ridges, the problem of widely spaced contact points arises if the pitch is greater than 2 millimeters or so. In a preferred embodiment for soft compliant ridges the ridges are flat-topped with the outer contact surface comprising at least 50% of the overall contact area. By this means, bulges or projections that would otherwise create a dominant contact are avoided. For the full range of possible material hardness h, the preferred TSF ratio is specified as follows:

where h>44 Shore D: TSF ratio>0.8−0.003×h where h<44 Shore D: TSF ratio is nominally ⅔.

The TSF ratio for hard ridges should be greater than 0.5 and less than 0.61, but is preferably between 0.53 and 0.59.

A re-entrant ridge-profile (profile narrowing with depth) can be used with soft materials; in this case the TSF can be as large as 0.72. Also, the gaps between ridges may be filled or partially filled with a material that is softer than the ridge material; this prevents extraneous matter from collecting inside the narrow gaps separating ridges. Furthermore, the impact surface may be provided as a replaceable member; this increases the scope for performance improvement designs using more delicate surface structures that can be renewed as required.

BRIEF DESCRIPTION OF THE DRAWINGS

Golf-putter heads in accordance with the present invention will now be described, byway of example, with reference to the accompanying drawings, in which:

FIGS. 17 and 18 together tabulate the characteristics of nine impact-faces tested.

DETAILED DESCRIPTION OF THE INVENTION

Figure 1:
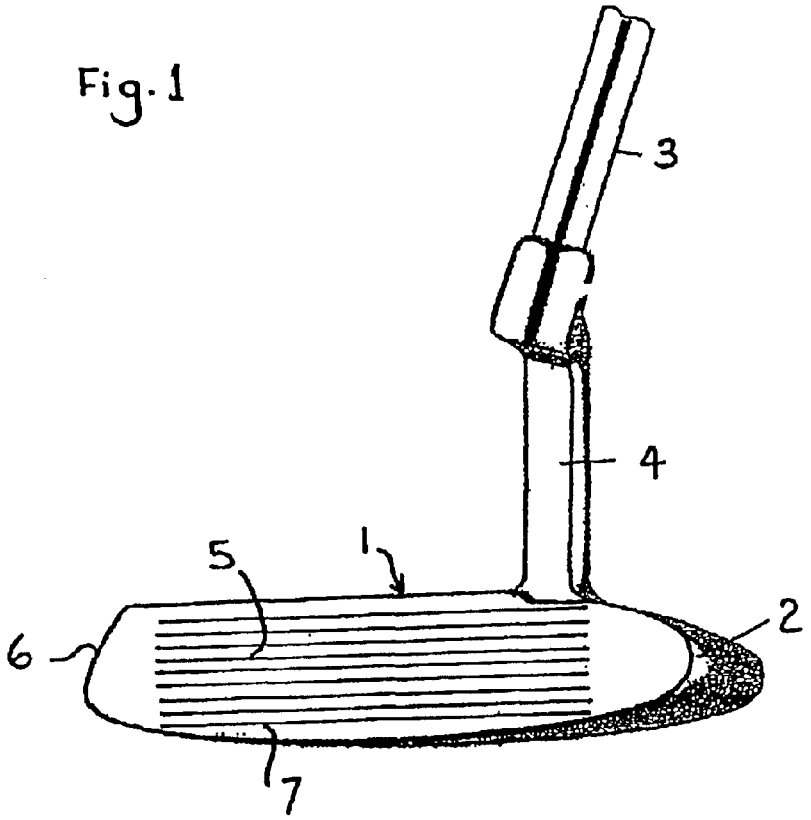
FIG. 1 shows the general configuration of a golf-putter head in accordance with the invention.

Referring to FIG. 1, the putter-head 1 is attached at its heel 2 to a putter-shaft 3 via a neck 4. The head 1 has an impact face 5, located between its heel 2 and toe 6, which is grooved to define a multiplicity of parallel ridges 7 that extend substantially lengthwise of the head 1, that is to say in the general direction from heel 2 to toe 6. The ridges 7 are of a high-impact material, being in the present example integral with the stainless-steel or brass head 1, and, as illustrated in FIG. 2, are spaced from one another by gaps larger than the widths of the ridges.

Figure 2:
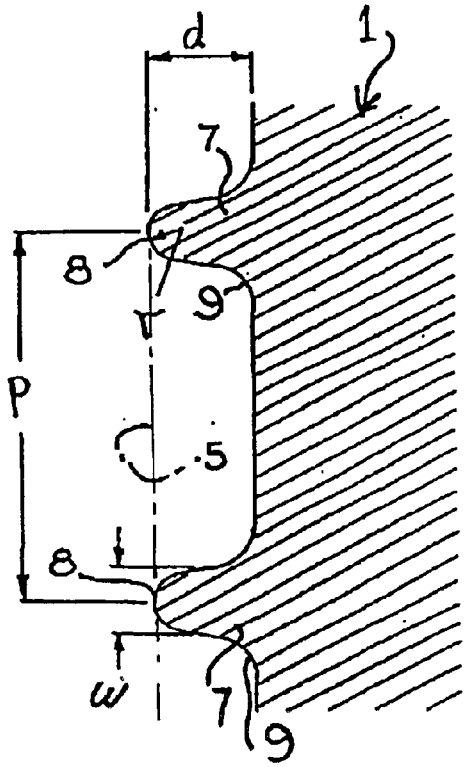
FIG. 2 is an enlarged vertical section of part of the golf-putter head of FIG. 1, illustrating one example of ridge-configuration according to the invention for the impact face of the putter-head and identifying certain variables associated therewith.

Referring to FIG. 2, the distance between corresponding points of adjacent ridges 7 is identified as their pitch p, and the distance between the apex 8 and base 9 of each ridge 7 as its depth d (measured normal to the impact face 5). The width w of each ridge 7 is its thickness measured at 0.2 millimeters below its apex, and its radius r is the radius of the ridge 7 at its apex. In this specific example, the pitch p of the ridges 7 is 1.6 millimeters being in this regard within the preferred range of 1.4 millimeters to 1.8 millimeters. An overall range of 1.0 millimeters to 2.0 millimeters is applicable provided the cross-sectional area of the ridge 7 is substantially less than the cross-sectional area of the gap separating adjacent ridges 7.

A wide spacing ensures that when adjacent ridges 7 strike the dimpled golf ball, they come into contact with different edge orientations of the same dimple, or with edges of adjacent dimples, so as to spread the force distribution at impact over a number of separate contact points with the ball. However, very wide spacing is counterproductive because the force contributions of ridges other than the central ridge or ridge pair, diminish rapidly and do not provide a well-distributed impact force. The improvement is unpredictable by theory so experimental methods have been adopted to determine optimum designs.

It is intended according to the invention that the ridges 7 penetrate deeply into the cover of the golf ball, preferably without cutting the cover. To this end, the radius r is ideally in the range 0.05 millimeters to 0.25 millimeters, but the radius can be increased up to 0.50 millimeters over a small section of the ridge tip provided the width is small enough to allow penetration. A cylindrical top surface for each ridge is preferred (as illustrated), but other ridge sections including polygons with various corner radil may be used.

The thickness of a ridge 7 near its base may be significantly greater than the average thickness since impact deformation near the base contributes little to the overall impact force; the nominal 'base' is located where the thickness of the ridge cross-section equals three times the thickness at 0.15 millimeters depth from the apex 54. Another consideration is that the ridges 7 are not prone to damage by accidental impact with hard objects. Thus it is advisable, but not a necessity, that the ratio d/w is less than three, and also that the depth d is just sufficient to allow impact penetration to the desired maximum depth. Because the contact-area pattern of the ridges 7 on a dimpled golf ball surface is random, excessive damage of the ridges 7 is required before significant performance degradation occurs.

It has been found that, compared with a plain, flat-faced putter-head, the ridge-faced putter according to the invention gives a perceptibly 'softer' impact (that is, with lower transient acoustic intensity, especially for high frequency components). This 'softer' characteristic derives from the more gradual application of impact energy to the ball, and the hardness of the ridge material has negligible effect. It is thus advantageous to fabricate the ridges, and the putter-head as a whole, of an extremely hard and durable material; this is not traditionally desirable in flat-faced putter designs. For example, a steel ridge-faced putter-head can be deep case hardened using a nitride hardening process and further surface protection can be provided with a titanium nitride (TiN) vacuum deposited coating. In addition to high resistance to wear, titanium-nitride coatings have an attractive metallic gold appearance, very high chemical inertness and low coefficient of friction, all of which enhance putter-head design.

The following formula gives a fairly accurate relationship between the maximum depth (millimeters) of a footprint and its span (millimeters) for golf balls:

$$\text{footprint depth} = 0.006 \times (\text{footprint span})^2$$

Here, the footprint span is taken to be equal to the diameter of a circular footprint that would be obtained with a flat putter on a smooth-surfaced golf ball. Thus, a footprint having a span of 5 millimeters (typical of a short putt with a hard covered golf ball) has a maximum footprint depth of only 0.15 millimeters. It has been found that dimple errors reduce to negligible levels with footprints having spans above 9 millimeters. A span of 9 millimeters equates to a footprint depth of 0.486 millimeters, and from this it can be determined that there is advantage in limiting ridge-depth to between 0.4 millimeters to 0.5 millimeters. Thus, in a typical embodiment, the following set of dimensions would obtain:

| | |
|---|---|
| p | 1.60 millimeters |
| d | 0.40 millimeters |
| w | 0.36 millimeters |
| r | 0.18 millimeters |

The outermost surfaces of the ridges are desirably substantially coplanar throughout the impact face. Where a convex design of overall putter face is involved, the outermost surfaces of the ridges desirably conform to substantially smooth surfaces of relevant curvature.

The ridges are normally of uniform cross-sectional dimensions and pitch throughout the putter face, but pitch and/or profile may be graduated in order to impart shaped force distribution properties to the impact area.

FIGS. 3 to 6 show ridge-configurations that may be used as alternatives to that of FIG. 2, in the putter-head 1 of FIG. 1.

Figure 3:
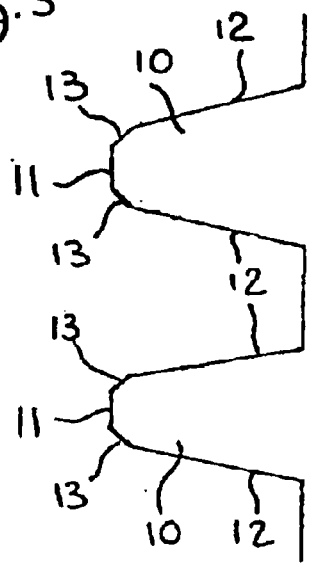
FIGS. 3 to 6 illustrate, respectively, additional examples of ridge-configurations according to the invention.

Referring to FIG. 3, the ridges 10 in this case have a symmetrical profile with a flat-top apex 11, flat main flanks 12 and flat intermediate flanks 13. The main flanks 12 may be angled, as shown, to converge towards the apex 11, or may be parallel to one another.

Figure 4:
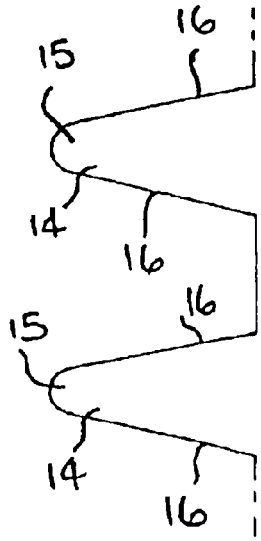
Figure 5:
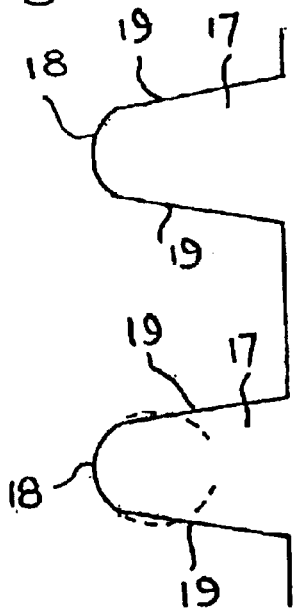

In FIG. 4, the ridges 14 have a profile that involves a curved, cylindrical tip 15 together with convergent flat-flanks 16 that are tangential to the tip 15. Similarly, in FIG. 5, ridges 17 have a profile that is curved at the apex 18 and has convergent flat-flanks 19, but in this case the flanks 19 are not tangential to the curve.

Figure 6:
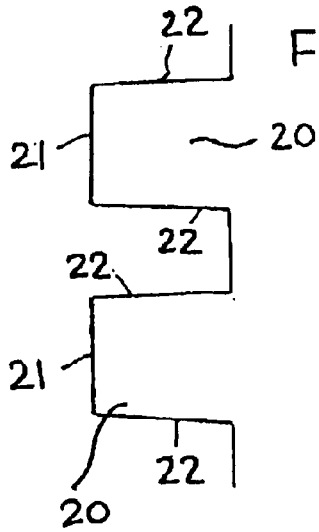

FIG. 6 illustrates a further ridge-profile in which the ridges 20 have a flat-top apex 21 and flat flanks 22 to give a substantially rectangular cross-section.

Figure 7:
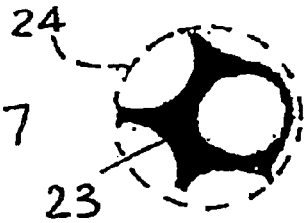
FIGS. 7 and 8 are enlarged views of footprint traces that result respectively from striking a golf ball having a dimpled soft-cover with a plain, flat-faced putter-head, and with a ridge-faced putter-head according to the present invention.
Figure 8:
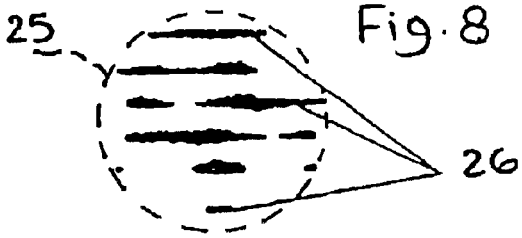

Footprint traces that result from striking a golf ball having a dimpled soft-cover with a plain, flat-faced putter-head, and with a ridge-faced putter-head according to the invention, are illustrated in FIGS. 7 and 8 respectively, for comparison purposes. The ball is struck in each case to produce an initial ball velocity of about 3 meters per second, and the ridges of the ridged putter-head have a pitch of about 1.4 millimeters.

As illustrated in FIG. 7, the footprint 23 of the flat-faced putter-head was delimited in practice by a circle 24 having a diameter of 7.0 millimeters. On the other hand, the circle 25, illustrated in FIG. 8, delimiting the footprint 26 of the ridge-faced putter-head was found to be 8.3 millimeters. This larger diameter for the footprint 26 indicates that penetration of the golf-ball surface by the ridge-faced putter-head was 40% deeper than by the flat-faced putter-head.

It is to be noted that the greater part of the contact area (black) of footprint 23 of FIG. 7 is contained left of centre of the circle 24. This means that in this (random) instance, the effective impact force was biased to the left of centre with the result that the ball would veer slightly to the right. In comparison, the total contact area for the ridge-faced putter-head in footprint 22 of FIG. 8, has a better lateral distribution throughout the circle 25, and comprises separate, substantially-horizontal contact areas made with the ball by six individual ridges of the head.

The dominant ridges (that is to say, those at or near the centre of the footprint) form relatively deep impact indentations, which, being generally horizontal, impede vertical slippage between the impact face and the ball during impact. Conversely, the ball is more able to slip laterally, along the length of the rounded and smooth topped ridges. These conditions are optimum for imparting topspin while at the same time minimising errors due to incorrect swing path.

Figure 9:
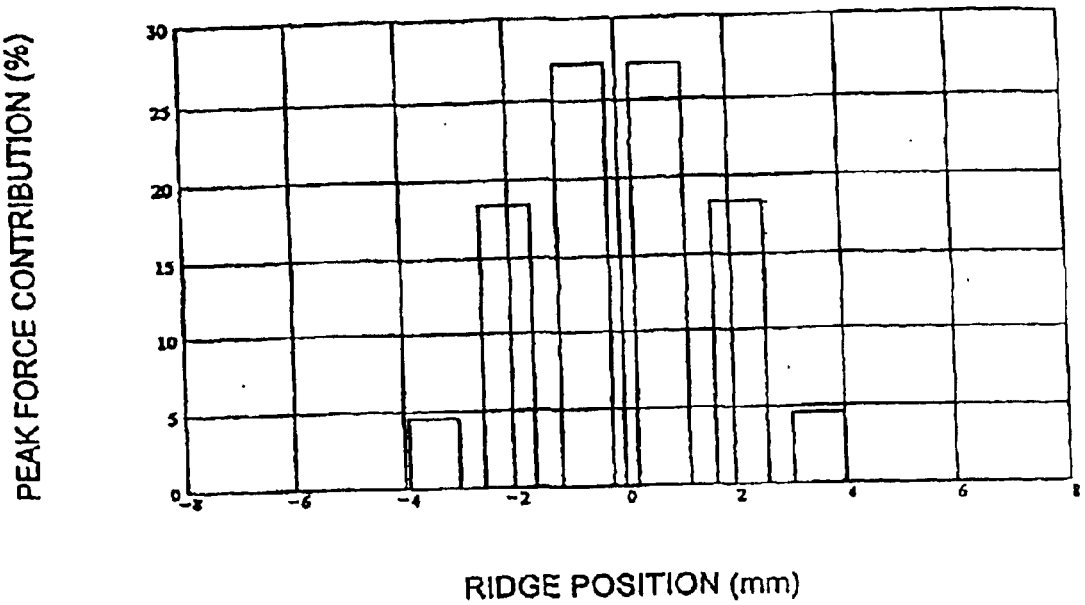
FIGS. 9 and 10 are graphical representations of the peak impact force contributions from two series of ridges according to the present invention, for which the ridge-spacings are different.
Figure 10:
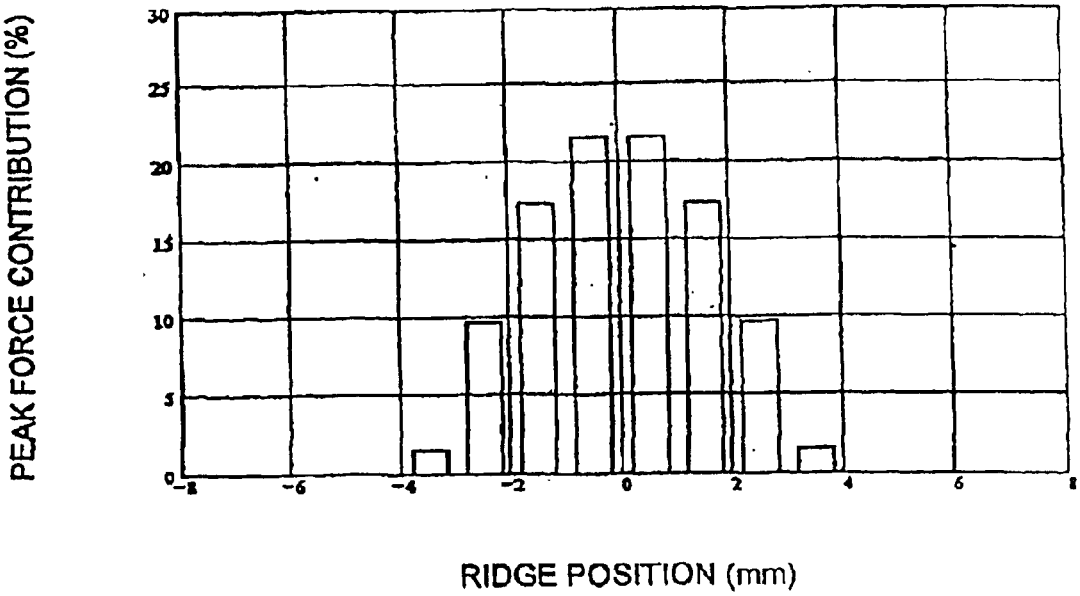

FIGS. 9 and 10 are bar graphs showing computed peak-force contributions as a percentage of total peak impact-force for adjacent ridges of putter-heads according to the present invention, in respect, respectively, of two different ridge configurations. For simplicity, use of a smooth-surfaced ball with diameter 42.7 millimeters (as for a golf ball) is considered, and it is assumed that the Hertz law of contact approximates the force-deformation relation. Thus, the force contribution from each ridge is taken as proportional to its depth of penetration raised to the power 3/2.

In the circumstances represented by FIG. 9 the ridge spacing is 1.4 millimeters and the depth of penetration is 0.41 millimeters (maximum), with six ridges contributing to the impact. This replicates the general impact conditions that obtained with footprint 26 of FIG. 8.

The ridge spacing for the circumstances represented in FIG. 10, is 1.0 millimeters and eight ridges contribute to the impact. From this it is revealed that a maximum depth of penetration of 0.34 millimeters is required to develop the same total peak force as obtained in the circumstances of FIG. 9. The peak depth of penetration is only 19% greater than that obtained with the flat-faced putter in footprint 23 of FIG. 7, whereas with the ridge spacing of 1.4 millimeters applicable to FIG. 9 a penetration 40% larger is achieved. Thus, with a ridge spacing of 1 millimeters or less, the increase in penetration relative to a flat-faced putter is significantly less than that obtained with a ridge spacing of 1.4 millimeters or more (all other factors being equal). Since increasing the depth of a footprint reduces dimple-effect errors, it is revealed that the ridge spacing of 1.4 millimeters is an improvement compared with the ridge spacing of 1.0 millimeters.

Figure 11:
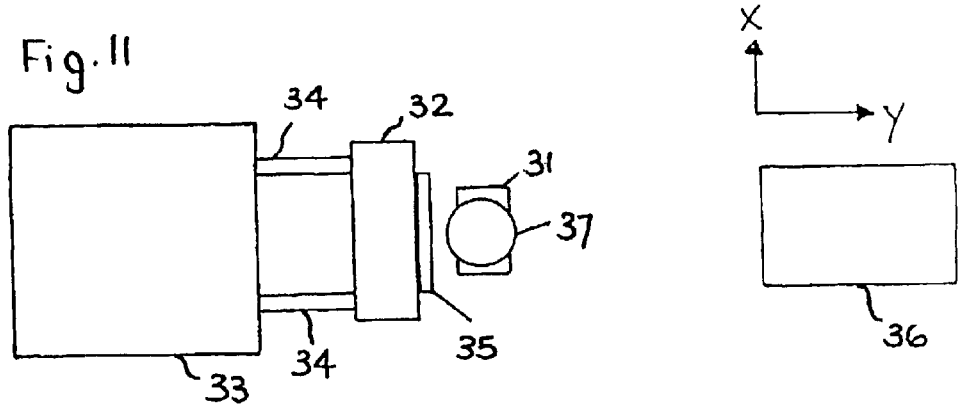
FIGS. 11 and 12 are, respectively, a schematic plan and side view of apparatus used for measuring dimple-effect errors.
Figure 12:
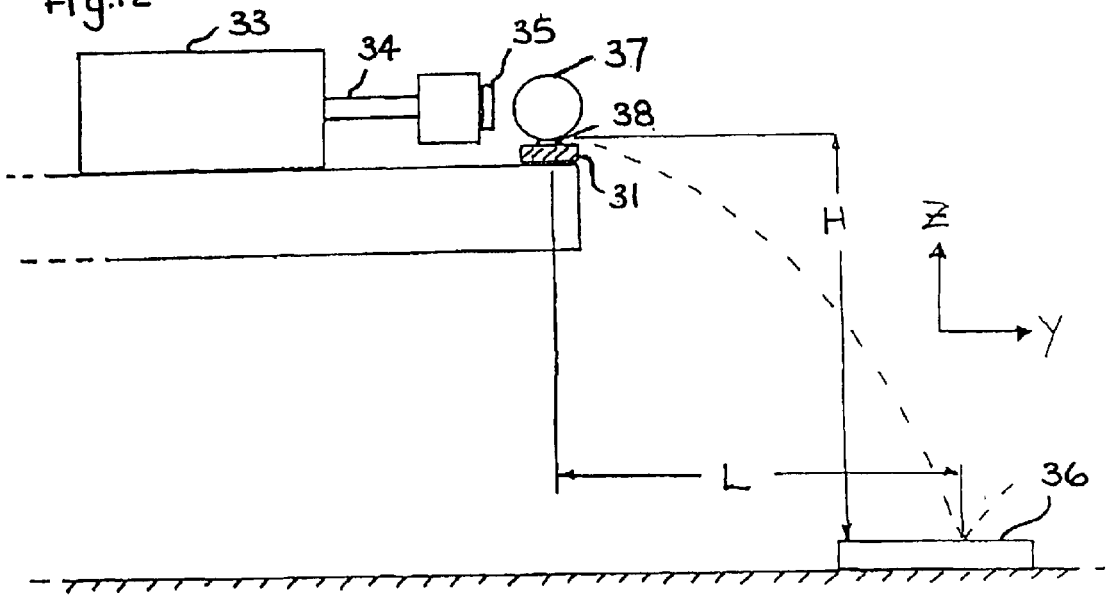

Measurement of dimple-effect error and obtaining statistical results for ridge-faced putter-heads according to the invention, can be readily carried out using the apparatus of FIGS. 11 and 12.

Referring to FIGS. 11 and 12, the apparatus includes a fixture 31 for positioning the ball in front of an impact block 32 that is coupled to a linear actuator 33 via parallel drive shafts 34. An impact-face member 35 under test is releasably attachable to the block 32 and a drop-impact recording plate 36 is used as a platform for recording results of the test.

The ball-position fixture 31 and the linear actuator 33 are mounted above floor-level with the plate 36 on the floor in front of them. A golf ball 37 is placed on the fixture 31 and the linear actuator 33 is then operated so that the ball 37 is hit by the member 35 under test. As struck by the member 35, the ball 37 is propelled through the air to drop onto the drop-impact plate 36 where the position of its landing is recorded as a mark on impact-sensitive paper. The process can be repeated to accumulate a series of test results for the relevant member 35, and then for other configurations of impact-face members substituted for the member 35.

The actuator 33 can be set to give precisely repeatable strokes and arranged to launch the golf ball 117 with initial linear velocity of 2.5 meters per second and negligible imparted spin. In the absence of dimple-effect error, the direction of ball-launch is initially along a horizontal Y-axis direction normal to the plane of the impact-face of the member 35, and the drop from the initial position of the golf ball to the landing position on the plate 36 is a known distance H measured along a vertical Z-axis. For a ball travelling horizontally with a velocity of 2.5 meters per second, the length L along the Y axis between its initial resting position and its impact on the plate 36 can be readily calculated. In particular, assuming that the local value of gravity is 9.81 meters per second per second, the value of L is calculated from:

$$L=1.129\times H^{1/2}$$

Thus when the height H is 0.785 meters the length L is 1.00 meter for an initial horizontal velocity of the ball of 2.5 meters per second.

With dimple-effect errors, the landing spot changes. Directional (that is, azimuthal) errors give rise to displacements along a horizontal X-axis transverse to the Y-axis, with the degree of angular error approximately proportional to the X-axis displacement and inversely proportional to L. Angular errors in launch elevation give rise to variations along the Y-axis, but the magnitude of these errors is approximately a quadratic function of L.

The apparatus of FIGS. 11 and 12 demonstrates the principle of ballistic techniques for measuring putter characteristics, and provides a very accurate means for determining dimple-effect errors. The use of a linear actuator in this is much preferred to other means using a mechanically-swung putter since it is difficult to maintain precisely repeatable impact conditions with a mechanically swung putter.

The accuracy of the apparatus of FIGS. 11 and 12 can be validated using a billiard ball, which has high spherical symmetry. In practice it is found that impact energy and angular errors in such a measurement system are very small compared with dimple-effect errors. The apparatus allows rapid testing of a ball or sample of balls. The drop impact recording plate 36 can with advantage be replaced by electro-optical means for measuring the ball displacement along the X-axis.

The design of the initial ball-position fixture 31 is critical. It is important that the ball 37 is placed in a fixed and stable initial rest position for each shot but the fixture 31 should not significantly interfere with the movement of the ball at impact. In this regard it has been found advantageous to form the member 31 of foam rubber and bond to it a nylon washer 38 (FIG. 12) having a hole diameter of 6.5 millimeters for seating the ball; this is sufficient for accurate location but also provides a very shallow seating. During impact, very little force is required to depress the washer 38 into the foam-rubber member 31 and so allow the ball to move virtually unimpeded.

The height of the fixture member 31 can be finely adjusted with shims (not shown) and this allows very accurate positioning of the initial position of the ball along the Z-axis. This is required to ensure that the height of the initial position of the ball relative to the impact-face member 35 is adjusted for worst case impact, that is to say, with the centre of a ridge coincident with the centre of impact. This condition can be verified using a smooth-surfaced golf ball substitute, having the same diameter as the test golf balls and recording the impact footprint of the impact-face member 35 on the smooth-surfaced ball. It is found that the arrangement of FIG. 12 gives very stable and precise control of the impact position along the Z-axis so that worst case impact can be reliably tested.

The ambient temperature of the test area should be monitored and controlled during measurement and comparative measurements of different impact-face members should be carried out at the same nominal ambient temperature. Handling of the test sample of balls should be minimised to ensure that they remain at ambient temperature during the testing.

In practice various refinements are required so that error results of several hundred or even thousands of shots can be efficiently recorded. It is believed that the dimple-effect characteristics of a given impact-face configuration and a given golf ball type are best evaluated by taking large measurement samples with random initial golf-ball orientations. The sample size depends on the degree of confidence and precision required in the statistical measurement. Random initial golf-ball positions are easily obtained since it is very difficult to orientate a golf ball to ensure either a minimum or maximum dimple-effect error.

The present invention seeks to provide reduction in dimple-effect errors relative to a hard flat-faced putter-head with specified ball type and putt strength. This reduction is measured as the difference in the standard deviations of dimple-effect errors for a putter-head according to the invention relative to a hard flat-faced putter-head. Preferably 99% confidence limits should apply. The upper limit of standard deviation for error measurements obtained with the improved dimple-effect impact-face should be a given percentage (85% or less) of the lower limit of standard deviation for dimple-effect error measurements obtained with the hard, flat-faced putter-head. In practice this means that the sample size (that is to say, the number of measurements) can vary depending on the margins of improvement obtained.

Figure 13:
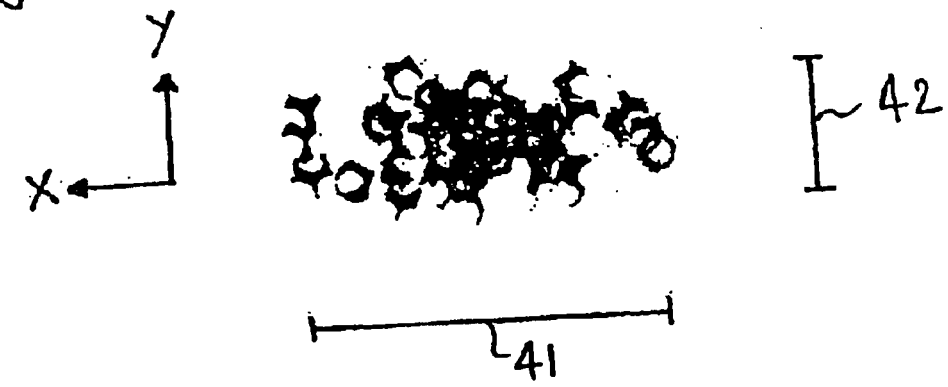
FIGS. 13 and 14 are illustrative of recordings made with the apparatus of FIGS. 11 and 12.
Figure 14:
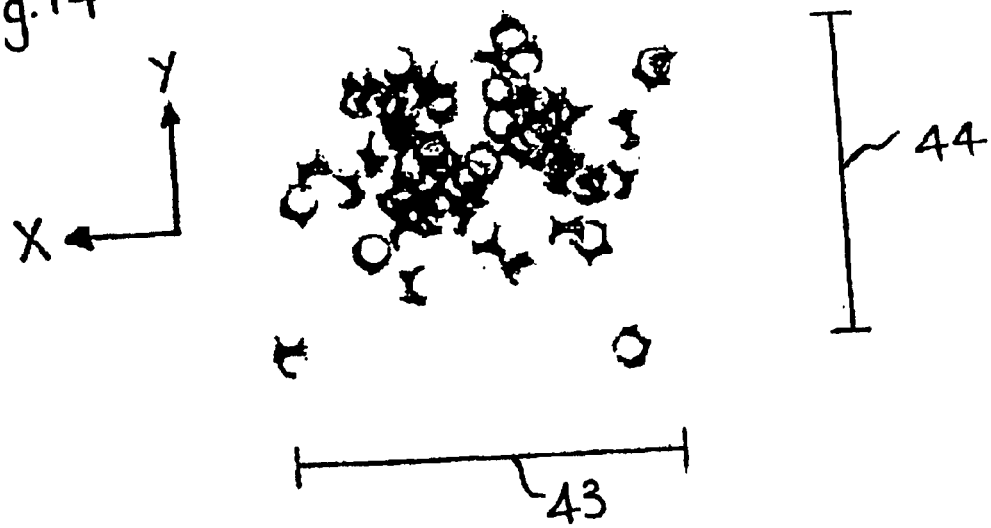

FIGS. 13 and 14 show records of dimple-effect errors for two different impact-face members. These records are in the form of scatter graphs showing deviations of landing spots on the recording plate 36 of FIGS. 11 and 12. FIG. 13 shows the deviations (due to dimple-effect errors) for a standard hard, flat-faced impact-face member for fifty shots, whereas FIG. 14 shows the results under the same measurement conditions as FIG. 13 except that the impact-face member, although again hard, was of the form of FIG. 3 with ridge widths of 0.4 millimeters and pitch of 3.0 millimeters. In FIG. 13, the overall range of X-axis deviations is marked as 41 and the overall range of Y-axis deviations as 42. Similarly in FIG. 14, the overall range of X-axis deviations is marked as 43, and Y-axis deviations as 44. It is to be noted that the marker 43 is about 10% longer than the marker 41 indicating that directional errors due to dimple-effect are slightly greater. Also, the marker 44 is about 140% longer than marker 42, showing that the impact-face member of the form applied in FIG. 14 degrades dimple-effect performance for elevation errors.

The scatter graphs of FIGS. 13 and 14 give an example where small samples of measurements are sufficient to differentiate between good and bad performance. The impact-face member that was used to obtain the results in FIG. 14 was of a ridge-faced form with pitch dimension of 3.0 millimeters. This pitch dimension is found to be too large as it introduces a strong dominant ridge effect that concentrates the initial contact force and produces gross inconsistencies in elevation performance as well as degrading rather than improving directional accuracy.

The scatter graph form of measurement is useful for quick initial evaluation of impact faces. For more detailed measurements, the position along the X-axis of each landing spot on the drop-impact recording plate 36 is required. Using a long strip or roll of impact-recording paper and shifting the Y-axis position of the paper after each shot can accomplish this. Successive shots are then separate and stretched out along the length of the paper. Y-axis information is lost, but the X-axis position of each shot is recorded and can be measured relative to the edge or other Y-axis reference on the strip or roll of paper. This technique has been used to analyze dimple-effect errors for a large variety of impact-face configurations, and further test results will now be described with reference to FIGS. 15 and 16.

Figure 15:
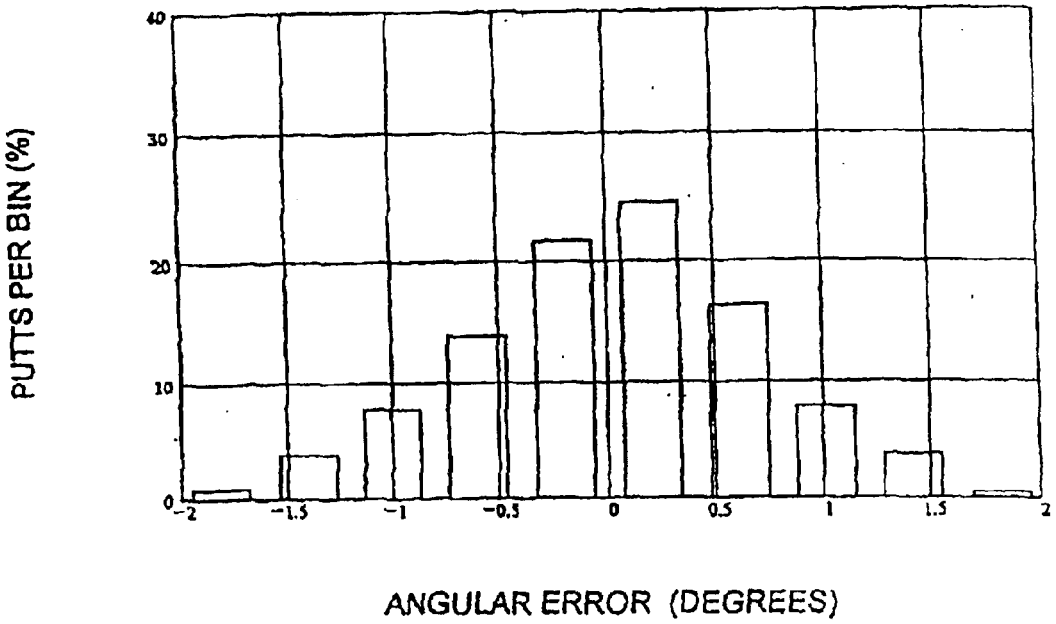
FIG. 15 is a histogram showing the distribution of dimple errors typical of putts on a hard-covered golf ball using a standard flat-faced putter.

FIG. 15 is a histogram showing the distribution of dimple errors from a SURLYN® covered golf ball using a standard flat-faced putter. The measurements were taken with the precision putting apparatus of FIGS. 11 and 12, recording the angular error of each putt. Measurements for a sample of five hundred putts were taken and the results sorted into bins of 0.4 degrees. Each bar in the histogram represents the number of putts per bin as a percentage of the total sample. The errors appear approximately normally distributed with measured standard deviation of 0.66 degrees.

Figure 16:
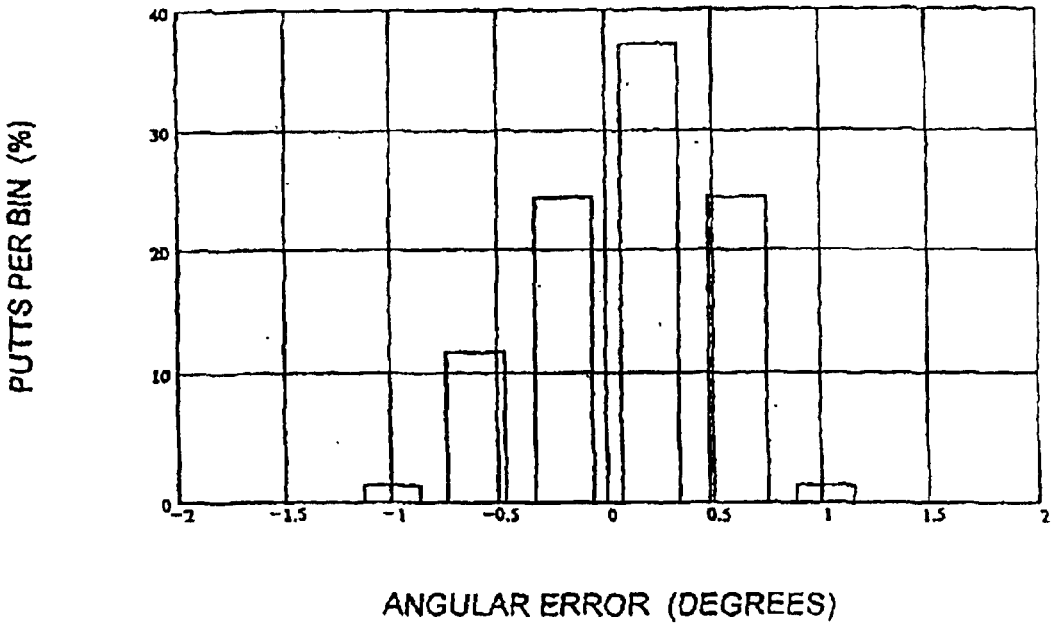
FIG. 16 is a histogram corresponding to that of FIG. 15, showing the distribution of dimple errors typical of putts on a hard-covered golf ball using a ridge-faced putter according to the present invention.

FIG. 16 correspondingly shows the distribution of dimple errors in a sample of two hundred and fifty putts (bin size 0.4 degrees) on the same SURLYN® covered golf ball using a ridge-faced putter-head of the form of FIG. 2. The ridges had a pitch of 1.6 millimeters, width of 0.32 millimeters and a depth of 0.32 millimeters. The tip shape was semi-cylindrical with a TSF of 0.58. The errors appear approximately normally distributed with measured standard deviation of 0.40 degrees—a reduction of about 40% compared with the results represented in FIG. 15. It is to be noted that the measurements of FIG. 16 were obtained with the height of the initial-ball position fixture 31 varied throughout the test to give an average of worst-case and best-case impact positions.

The characteristics of a variety of hard and soft ridge-faced impact faces are recorded in FIGS. 17 and 18, the results for six hard impact-faces being tabulated in FIG. 17, and for three soft impact-faces (all of the same grade of softness) in FIG. 18. The standard deviation s determined from each test using a sample size N, is indicated in the last line of each table. All measurements were carried out using one type of hard-covered golf ball with a launch velocity of 2.50 meters per second ±1% and with the impact-face member 35 of the apparatus of FIGS. 11 and 12 positioned so that a ridge centre was substantially coincident with the centre of impact. Ambient temperature was maintained in the range 16 to 18 degrees Celsius.

Referring to FIG. 17, test No. 1 relates to a hard flat-face putter. This test used a large sample (N=1055) in order to establish the basic dimple-effect performance of the ball-type used. The ball used was such as sold under the trade mark DUNLOP DDH 110, and the standard deviation of the sample was found to be 0.72 degrees. The measurements give 90% confidence that the population standard deviation for dimple-effect errors lie within the limits 0.69 to 0.75 degrees at 17 degrees Celsius. Preferably, all estimates of the performance of an impact surface should be carried out with a sample of golf balls whose standard deviation for dimple-effect errors lie within the above limits or equals that of the ball used, to within ±4%.

Test No. 2 relates to the ridge configuration of a currently-marketed putter. The ridge profile (which as with all profiles shown in FIG. 17, is represented with a 15× magnification) has a flat apex giving a high value of TSF outside the preferred range for hard ridges. The improvement in worst-ase dimple-effect errors is only about 8%.

Test No. 3 relates to an experimental ridge configuration comprising a semi-cylindrical tip (radius 0.34 millimeters) with width slightly larger than the ridge shape of test No. 2 but with reduced TSF. Although the width is greater (which would tend to reduce improvement) the reduced TSF results in a significant improvement compared with test No. 2.

Test No. 4 relates to a second experimental ridge configuration with radius reduced to 0.18 millimeters giving a width of 0.36 millimeters. It can be seen that the reduction in width significantly improves performance. Worst-case performance in the sample was measured as 26% below that of test No. 1 and overall performance is expected to be about 40% below or better.

Tests No. 5 and 6 used very small TSF ridges and were fabricated using precision wire erosion machining. The data indicates that the lower TSF resulting from the smaller tip radii (0.05 millimeters in both cases) does not reduce dimple-effect errors to the same degree as the ridge configuration of test No. 4, or in any case provides limited improvement. It is believed that this is due to higher plastic deformation at impact and it is therefore considered that TSF values below 0.5 do not meet the aims of the invention.

Referring now to FIG. 18, test No. 7 relates to a flat-faced putter with one type of soft material, which was also used to fabricate rectangular-section ridge configurations (with TSF of 0.667) used for test Nos. 8 and 9. This material gave a nominally 15% improvement in dimple-effect performance relative to the hard surface of test No. 1.

Test No. 8 demonstrates the dominant ridge effect in soft materials. The second design (again based on FIG. 7) has a pitch of 3.3 millimeters and a ridge-width of 1.4 millimeters. These measurements show a very severe degradation of 26% increased standard deviation compared with the flat-faced face of the same material, and are also worse than a flat-faced hard impact face.

Test No. 9 shows that reducing the pitch to 1.6 millimeters (in this particular material) and slightly reducing the width improves performance significantly, namely 10% better than the flat-faced impact-face of the same material and 24% better than the standard hard face.

The measurements of FIG. 18 demonstrate that when using soft impact-faces with rectangular-profile ridges performance is strongly affected by the dimensions used.

Figure 19:
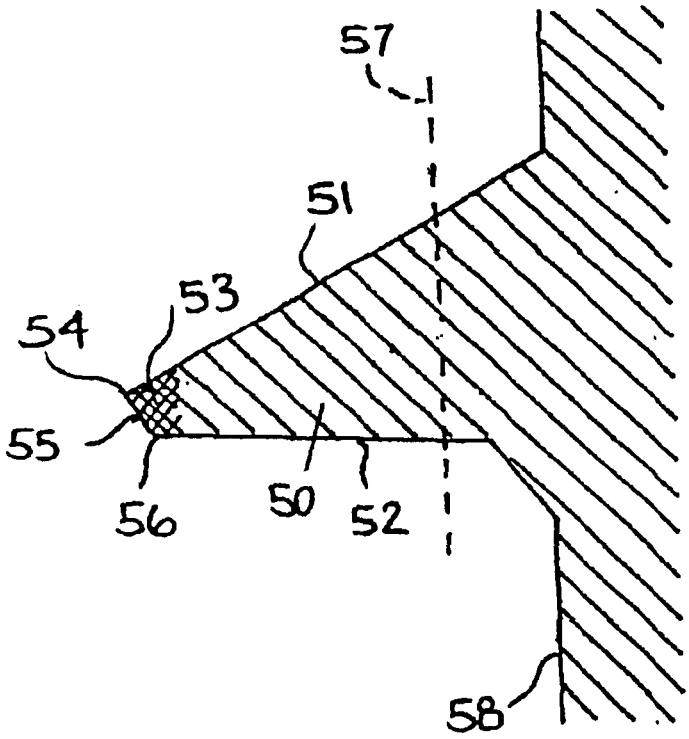
FIGS. 19 to 21 illustrate, respectively, further examples of ride configurations according to the invention.
Figure 20:
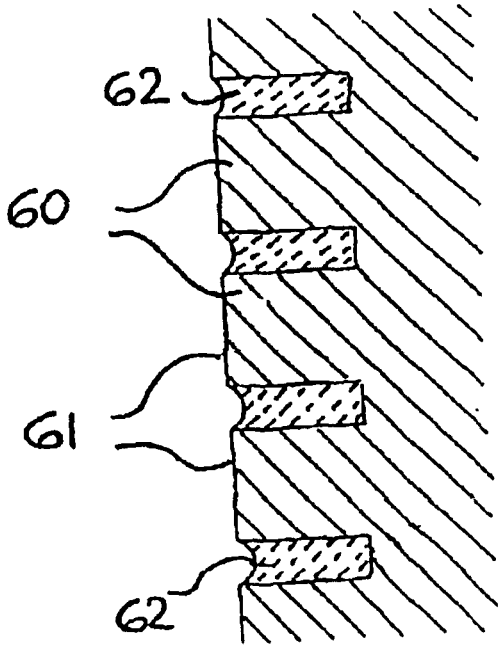
Figure 21:
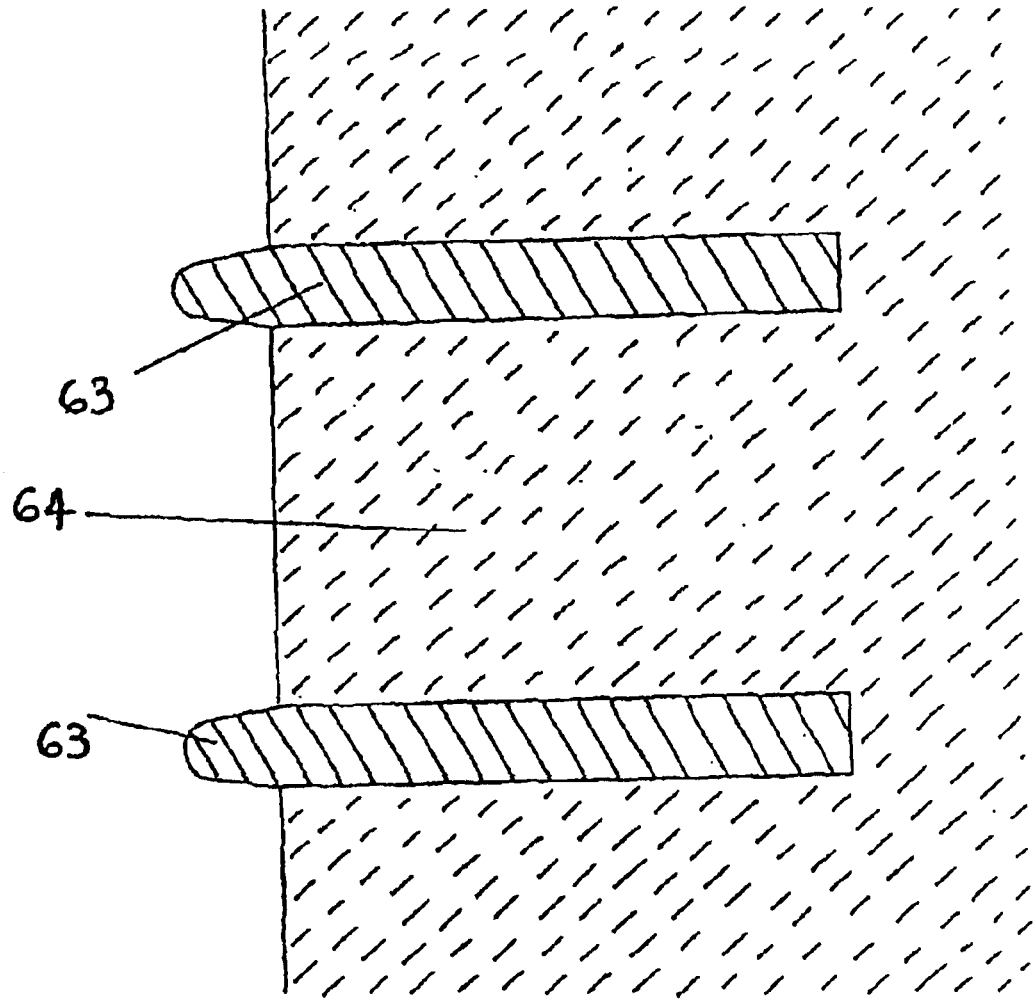

Three alternative ridge-profiles are illustrated in FIGS. 19 to 21 and will now be described.

Referring to FIG. 19, a ridge 50 in this case has an asymmetric profile for use with hard material. The ridge 50 has upper and lower flanks 51 and 52 and a tip 53 (distinguished by crosshatching). The tip 53, which extends from the apex 174 to a depth of 0.15 millimeters, comprises a variety of shape features, namely a sharp cornered apex 54, an outer, angled flat 55 and a rounded corner 56. The nominal base 57 (Indicated by dashed-line) of the ridge 50 extends parallel to the putter face 58 being (in accordance with the definition of "base") located where the thickness of the ridge cross-section equals three times the thickness at 0.15 millimeters depth from the apex 54. In most practical forms of ridge construction, mechanical features at depths beyond the defined base have negligible effect on putting performance.

FIG. 20 shows an arrangement Involving soft resilient-ridges according to the invention.

Referring to FIG. 20, the ridges 60 in this case are of a rectangular profile having a flat-top apex 61. The gaps between the ridges 60 are filled with material 62 of several durometer points softer than the ridges 60, which themselves may be softer than the golf ball. The purpose of the filling material 62 is to prevent ingress of dirt inside the narrow deep gaps or grooves between ridges. Different colour materials may be used for the ridges 60 and filler material 62 for cosmetic effect. The filling material 62 may protrude or be flush with the apex 61, or may be under-flush (as shown).

Most of the impact force on a golf ball by the impact-face of FIG. 20, is transmitted via the ridges 60. The filling material 62 does not prevent deflection of the ridges 60 when subject to vertical shear forces or to lateral expansion under normal deformation forces. Thus, the filling material 62 contributes only a minor part of the impact forces on the ball. In this context, the gap between ridges 60 is defined as the thickness of the filling material 62 at a depth of 0.2 millimeters from the apex 61.

FIG. 21 shows an arrangement in which hard ridges 63 are embedded in a soft resilient base 64. In a preferred arrangement, each ridge 63 is separately formed from strip steel or other hard material and is embedded into the resilient base 64 with its outer surface or apex substantially coplanar with that of each other ridge 63 and such as to create an array of substantially parallel horizontal ridges of uniform pitch. The ridges 63 may be interconnected with one another to facilitate assembly.

The projecting parts of the ridges 63 are preferably dimensioned in a corresponding manner to the ridges of FIGS. 2 to 5. The ridges 63 preferably extend deeply into the base 64 so that they are firmly embedded, and may be bonded to the base 64 or a tight fit into mating slots in it (allowing individual ridges 63 to be replaced).

What is claimed is:

1. A golf-putter head having an impact face for striking a dimpled surface of a golf ball, the impact face being defined by a multiplicity of substantially parallel ridges which extend substantially lengthwise along a head with a pitch p, and which each has a hardness h and a width value w, the width value w being one of a first value w1 and a second value w2, the first value w1 being equal to the width of each ridge measured at 67% of ridge-depth from en apex, and the second value w2 being equal to the width of each ridge measured at a depth of 0.2 millimeters from the apex, the width value w being equal to w1 when the ridge-depth is not more than 0.3 millimeter and being equal to w2 when the ridge-depth is more than 0.3 millimeter, the ridges each having a profile represented by a parameter TSF that is related to p, h, and w as follows:

$$1.0<p<400/(h+100)$$

$$w<0.4\times p[80/(h-20)]$$

$$0.5<TSF<(0.91-0.003\times h)$$

for p not exceeding 3.5, w not exceeding (p−0.4) and TSF not exceeding 0.72, where h is measured in durometer Shore D scale, w and p in millimeters and TSF is a ratio of a cross-sectional area of a ridge-profile measured to a depth of 0.1 millimeters from the apex to a cross-sectional area measured to a depth of 0.15 millimeters from the apex.

2. The golf-putter head according to claim 1, wherein the ridges have a durometer hardness h which is not less than 99 Shore D.

3. The golf-putter head according to claim 2, wherein the pitch p is substantially within a range 1.4 millimeters to 1.8 millimeters.

4. The golf-putter head according to claim 2, wherein the width w is less than:

$$0.4\times(p-0.4).$$

5. The golf-putter head according to claim 2, wherein the ratio TSF is substantially within the range 0.53 to 0.59.

6. The golf-putter head according to claim 2, wherein gaps between the ridges contain material which is softer than that of the ridges.

7. The golf-putter head according to claim 1, wherein the ridges have a durometer hardness h less than 99 Shore D.

8. The golf-putter head according to claim 7, wherein the ridges have a pitch p substantially within a range 1.5 millimeters to 2.5 millimeters.

9. The golf-putter head according to claim 7, wherein each ridge has a flat-topped apex extending throughout at least 50% of the ridge-pitch, and the ratio TSF is less than 0.67.

10. The golf-putter head according to claim 7, wherein gaps between the ridges contain material which is softer than that of the ridges.

11. The golf-putter head according to claim 1, wherein the head realizes a reduction of at least 15% in the standard deviation of the dimple-effect error distribution in putting with an initial velocity of 2.5 meters per second of a ball that when putted at that initial velocity by a head having a plain, flat impact face exhibits a standard deviation of dimple-effect error distribution within the range 0.69 degrees to 0.75 degrees.

12. The golf-putter head according to claim 11, wherein the reduction in the standard deviation is at least 20%.

13. The golf-putter head according to claim 12, wherein the reduction in the standard deviation is at least 25%.

14. A golf-putter head having an impact face for striking a dimpled surface of a golf ball, the impact face being defined by a multiplicity of substantially parallel ridges which extend substantially lengthwise along a head and which are for impacting a ball-surface in areas of contact that are distributed around dimples of that surface to center the resultant striking force on the ball, wherein each ridge has a width w in millimeters, measured at 67% of ridge-depth from an apex in the event that the ridge-depth is 0.3 millimeters or less, but otherwise measured at a depth of 0.2 millimeters from an apex for which:

$$w<0.4\times p\times[80/(h-20)]$$

where p is pitch of the ridges in millimeters and h is hardness measured in durometer Shore D scale, the pitch p is not less than 1.0 millimeter, and a ratio (TSF) of a cross-sectional area of a ridge-profile measured to a depth of 0.1 millimeters from the apex, to a cross-sectional area measured to a depth of 0.15 millimeters, is larger than 0.5, the combination of profile, width, pitch and hardness of the ridges realizing a reduction of at least 15% in a standard deviation of a dimple-effect error distribution in putting with an initial velocity of 2.5 meters per second of a ball that when putted at that initial velocity by a head having a hard plain, flat impact face exhibits a standard deviation of dimple-effect error distribution within the range 0.69 degrees to 0.75 degrees.

15. The golf-putter head according to claim 14, wherein the ridges have a durometer hardness which is not less than 99 Shore D.

16. The golf-putter head according to claim 15, wherein the pitch p is substantially within a range 1.4 millimeters to 1.8 millimeters.

17. The golf-putter head according to claim 15, wherein the ratio (TSF) is smaller than 0.61.

18. The golf-putter head according to claim 15, wherein the ratio (TSF) is larger than 0.53 but smaller than 0.59.

19. The golf-putter head according to claim 15, wherein the width w is less than:

$$0.4\times(p-0.4).$$

20. The golf-putter head according to claim 14, wherein the ridges have a durometer hardness less than 99 Shore D.

21. The golf-putter head according to claim 20, wherein the pitch p is substantially within the range 1.5 millimeters to 2.5 millimeters.

22. The golf-putter head according to claim 20, wherein each ridge has a flat-topped apex, each fat-topped apex extending throughout at least 50% of the ridge-pitch, and the ratio (TSF) is less than 0.67.

23. The golf-putter head according to claim 14, wherein a reduction In the standard deviation is at least 25%.

24. A golf-putter head in combination with a golf ball, with the golf ball comprising:

a center and a spherical outer surface having dimples therein, the golf ball having a deviation of dimple-effect error distribution within a range of between 0.69 degrees to 0.75 degrees when the dimpled outer surface is struck by a plain, flat impact face to launch the ball with a velocity of 2.5 meters per second; and the golf-putter head comprises a heel, a toe spaced from the heel, and an impact face located between the heel and toe, the impact face being defined by a multiplicity of substantially parallel ridges which provide a striking contact with the dimpled outer surface of the ball and produce a resultant striking force on the ball, the striking contact between the impact face and the dimpled outer surface being in areas of the dimpled outer surface that are distributed around a plurality of the dimples, the parallel ridges extending substantially lengthwise along the impact face between the heel and toe, and the parallel ridges having a strike-defining property comprising a profile, a width, a pitch and a hardness;

areas of contact between the parallel ridges and the dimpled outer surface vary depending on the strike-defining property of the parallel ridges for aligning the striking force with the center of the ball, to reduce the deviation of the dimple-effect error distribution of the ball at the launch velocity of 2.5 meters per second, by at least 15%.

25. The golf-putter head and the golf ball combination according to claim 24, wherein the parallel ridges have a durometer hardness which is not less than 99 Shore D.

26. The golf-putter head and the golf ball combination according to claim 25, wherein the parallel ridges have a pitch substantially within the range 1.0 millimeter to 2.0 millimeters.

27. The golf-putter head according to claim 26, wherein the parallel ridges have a pitch substantially within the range 1.4 millimeters to 1.8 millimeters.

28. The golf-putter head and the golf ball combination according to claim 25, wherein a ratio of a cross-sectional area of a ridge-profile measured to a depth of 0.1 millimeters from an apex to a cross-sectional area measured to a depth of 0.15 millimeters, is larger than 0.50 but smaller than 0.61.

29. The golf-putter head and the golf ball combination according to claim 28, wherein the ratio is larger than 0.53 but smaller than 0.59.

30. The golf-putter head and the golf ball combination according to claim 25, wherein each parallel ridge has a depth measured from an apex to a base larger than 0.3 millimeters.

31. The golf-putter head and the golf ball combination according to claim 30, wherein each parallel ridge has a width measured in millimeters at the depth of 0.2 millimeters from the apex, that is less than:

$$0.4\times p$$

where p is a pitch of the parallel ridges measured in millimeters.

32. The golf-putter head and the golf ball combination according to claim 31, wherein the width measured In millimeters is less than:

$$0.4\times(p-0.4).$$

33. The golf-putter head and the golf ball combination according to claim 25, wherein each parallel ridge has a depth measured from an apex to a base of 0.3 millimeters or less.

34. The golf-putter head and the golf ball combination according to claim 33, wherein each parallel ridge has a width measured in millimeters at 67% of ridge-depth from the apex, that is less than:

$$0.4\times p$$

where p is a pitch of the parallel ridges measured in millimeters.

35. The golf-putter head and the golf ball combination according to claim 34, wherein the width measured in millimeters is less than:

$$0.4\times(p-0.4).$$

36. The golf-putter head and the golf ball combination according to claim 25, wherein a ratio of a cross-sectional area of a ridge-profile measured to a depth of 0.1 millimeters from an apex, to the cross-sectional area measured to a depth of 0.15 millimeters from the apex, is substantially within a range 0.53 to 0.59.

37. The golf-putter head and the golf ball combination according to claim 25, wherein the parallel ridges are embedded in material which is softer than that of the parallel ridges.

38. The golf-putter head and the golf ball combination according to claim 24, wherein the parallel ridges have a durometer hardness less than 99 Shore D.

39. The golf-putter head and the golf ball combination according to claim 38, wherein the parallel ridges have a pitch substantially within a range 1.0 millimeter to 3.5 millimeters.

40. The golf-putter head according to claim 39, wherein the parallel ridges have a pitch substantially within the range 1.5 millimeters to 2.5 millimeters.

41. The golf-putter head and the golf ball combination according to claim 38, wherein each parallel ridge has a flat-topped apex extending throughout at least 50% of a ridge-pitch, end a ratio of a cross-sectional area of a ridge-profile measured to a depth of 0.1 millimeters from an apex, to a cross-sectional area measured to a depth of 0.15 millimeters from the apex, is less than 0.67.

42. The golf-putter head and the golf ball combination according to claim 38, wherein gaps between the parallel ridges contain material which is softer than that of the parallel ridges.

43. The golf-putter head and the golf ball combination according to claim 24, wherein a reduction in a standard deviation is at least 20%.

44. The golf-putter head and the golf ball combination according to claim 43, wherein the reduction In the standard deviation is at least 25%.

* * * * *